US012527413B2

(12) United States Patent
Bradshaw

(10) Patent No.: US 12,527,413 B2
(45) Date of Patent: Jan. 20, 2026

(54) HIGHCHAIR WITH AN AUTOMATED TRAY

(71) Applicant: Jodi Bradshaw, Greer, SC (US)

(72) Inventor: Jodi Bradshaw, Greer, SC (US)

( * ) Notice: Subject to any disclaimer, the term of this patent is extended or adjusted under 35 U.S.C. 154(b) by 171 days.

(21) Appl. No.: 18/214,268

(22) Filed: Jun. 26, 2023

(65) Prior Publication Data

US 2023/0329445 A1 Oct. 19, 2023

Related U.S. Application Data

(63) Continuation of application No. 17/569,909, filed on Jan. 6, 2022, now Pat. No. 11,684,171.

(60) Provisional application No. 63/134,706, filed on Jan. 7, 2021.

(51) Int. Cl.
*A47D 1/00* (2006.01)

(52) U.S. Cl.
CPC ..... *A47D 1/002* (2013.01); *A47D 1/0081* (2017.05)

(58) Field of Classification Search
CPC .... A47D 1/0081; A47D 1/0083; A47D 1/023; A47C 7/70
See application file for complete search history.

(56) References Cited

U.S. PATENT DOCUMENTS 1,859,150 A * 5/1932 Moran ..... A47D 1/0081 297/149
2,522,087 A * 9/1950 Boudreau ..... A47D 1/0081 297/150
2,799,324 A * 7/1957 Anderson ..... A47D 1/0083 297/145
3,547,488 A * 12/1970 Barnes ..... A47C 7/70 297/154
4,288,123 A * 9/1981 Cone ..... A47D 1/0085 297/154
4,768,825 A 9/1988 Quinlan, Jr.
4,946,180 A * 8/1990 Baer ..... A47D 1/0081 280/47.38
4,958,885 A 9/1990 Kassai
5,238,292 A 8/1993 Golenz et al.
5,413,400 A * 5/1995 Llanes ..... A47C 4/10 297/154
5,507,550 A 4/1996 Maloney
5,806,922 A 9/1998 Mendelovich
(Continued)

FOREIGN PATENT DOCUMENTS

DE 2822398 A1 * 11/1979
DE 20015929 U1 * 1/2001 ..... A47D 1/002

*Primary Examiner* — Timothy J Brindley
(74) *Attorney, Agent, or Firm* — ALLEN, DYER, DOPPELT + GILCHRIST, P.A.

(57) ABSTRACT

A highchair includes a seat configured for a child to sit, and a frame having a first side and a second side where the frame is attached to and supporting the seat at a height. The highchair also includes a tray having a first edge rotatably secured to the first side of the frame and configured to rotate between a down position and a raised position about the first edge. The highchair also includes a spring loaded lifting mechanism coupled to the first edge of the tray that is biased to rotate the tray from the down position to the raised position so the seat can be accessed. In addition, the highchair includes a pedal coupled to a lower portion of the frame and configured to be pushed by a foot to cause the tray to release and rotate upwards to the raised position by the spring loaded lifting mechanism.

13 Claims, 4 Drawing Sheets

(56) References Cited

U.S. PATENT DOCUMENTS

| | | | | |
|---|---|---|---|---|
| 6,224,149 | B1 * | 5/2001 | Gevaert | A47C 7/70 297/162 |
| 6,416,124 | B1 | 7/2002 | Chen et al. | |
| 7,883,145 | B2 | 2/2011 | Troutman et al. | |
| 9,986,850 | B2 | 6/2018 | Haut et al. | |
| 10,137,990 | B2 | 11/2018 | Lee et al. | |
| 10,300,825 | B2 | 5/2019 | Akaike et al. | |
| 10,588,425 | B1 * | 3/2020 | Jordan | B62B 7/008 |
| 10,926,880 | B1 | 2/2021 | Mayne et al. | |
| 11,013,332 | B2 | 5/2021 | Xiao et al. | |
| 2006/0207021 | A1 | 9/2006 | Brunson et al. | |
| 2006/0220349 | A1 | 10/2006 | Wolf et al. | |
| 2008/0122270 | A1 * | 5/2008 | Dubiel | A47D 1/0085 297/173 |
| 2009/0039684 | A1 * | 2/2009 | Chen | A47D 1/006 297/16.1 |
| 2016/0135598 | A1 | 5/2016 | Andoloro et al. | |
| 2017/0251826 | A1 | 9/2017 | Sclare et al. | |
| 2020/0100594 | A1 | 4/2020 | Fietz et al. | |
| 2021/0120961 | A1 * | 4/2021 | Griepentrog | A47C 7/70 |
| 2023/0172362 | A1 * | 6/2023 | Suzuki | A47C 7/705 297/145 |

* cited by examiner

HIGHCHAIR WITH AN AUTOMATED TRAY

CROSS-REFERENCE TO RELATED APPLICATIONS

This application claims priority to U.S. application Ser. No. 17/569,909 filed Jan. 6, 2022, now U.S. Pat. No. 11,684,171 issued Jun. 27, 2023, which claims priority to U.S. Provisional Application Ser. No. 63/134,706 filed on Jan. 7, 2021 the contents of which are herein incorporated by reference in their entirety.

FIELD

The present invention relates to the field of highchairs for children, and, more particularly, to a highchair with an automated tray.

BACKGROUND

Highchairs provide a raised seat for children so that they are at the same height as a table. A removable eating tray is often used so that the child does not eat directly off the table but from his or her own tray.

While the tray has been a beneficial attachment and improvement to highchairs, the tray can also be an impediment. For example, when the adult is placing the child into the highchair, the tray must be up. However, often times the tray may be down and the adult has their hands full holding the child. The adult has to then place the child down, move the tray up, and pick the child back up in order to place them into the highchair. This can be a disruptive process to the child and physically straining to the adult.

Accordingly, there is a need for a highchair that has an improved tray configuration and that is easy to use for adults.

SUMMARY

A highchair for seating a child is disclosed. The highchair includes a seat configured for a child to sit, and a frame having a first side and a second side. The frame is attached to and supporting the seat at a height. The highchair also includes a tray having a first edge and an opposing second edge, where the first edge is rotatably secured to the first side of the frame and configured to rotate between a down position and a raised position about the first edge. In addition, the highchair includes a spring loaded lifting mechanism coupled to the first edge of the tray and biased to rotate the tray from the down position over the seat to the raised position so the seat can be accessed, and a pedal coupled to a lower portion of the frame and configured to be pushed by a foot, wherein the pedal when pushed causes the tray to release and rotate upwards to the raised position by the spring loaded lifting mechanism and remain in the raised position.

The highchair includes a latch catch mechanism coupled to the second side of the frame to secure the second edge of the tray thereto until the pedal is pushed. The second edge of the tray includes a latch configured to cooperate with the latch catch mechanism to secure the tray in the down position. The highchair also includes a linkage between the pedal and the latch catch mechanism, where the linkage is configured to cause the latch catch mechanism to release the latch when the pedal is pushed. In a particular aspect, the linkage comprises a cable. The pedal may have a safety lock configured to prevent the pedal from being pushed and releasing the latch.

In addition, the highchair may include a tray lock coupled between the second side of the frame and the linkage and configured to prevent the linkage from moving and releasing the latch. The latch may comprise a male fitting having an aperture therethrough, and the latch catch mechanism may have a female fitting for receiving the male fitting and securing the latch through the aperture.

The frame of the highchair has four legs and is configured to collapse the four legs together for storing the highchair, and the tray is removable from the frame.

Other aspects, advantages, and features of the present disclosure will become apparent after review of the entire application, including the following sections: Brief Description of the Drawings, Detailed Description, and the Claims.

DETAILED DESCRIPTION

Figure 1:
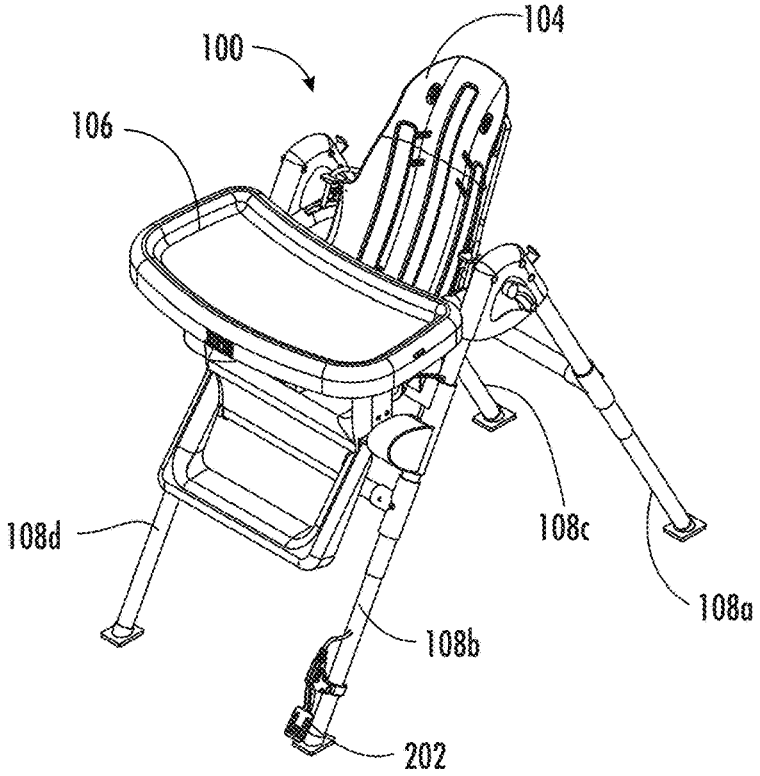
FIG. 1 is a top perspective view of a highchair in which various aspects of the disclosure may be implemented.
Figure 2:
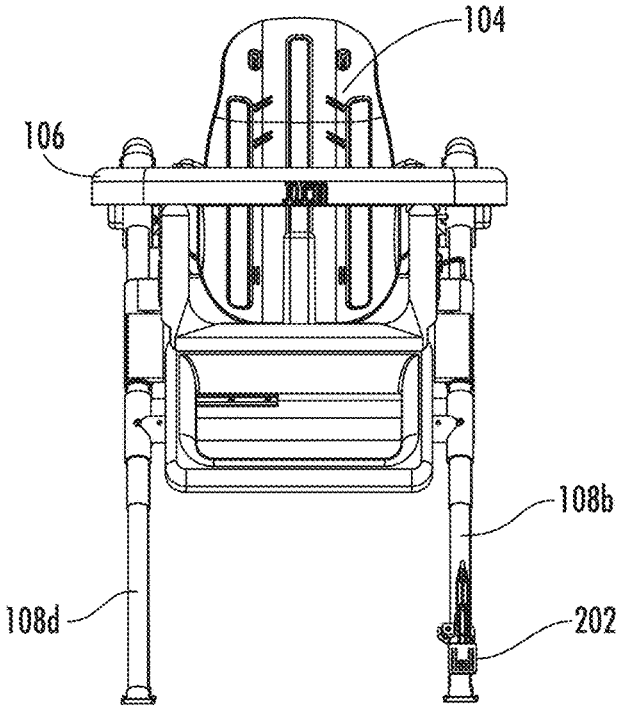
FIG. 2 is a front view of the highchair of FIG. 1.
Figure 3:
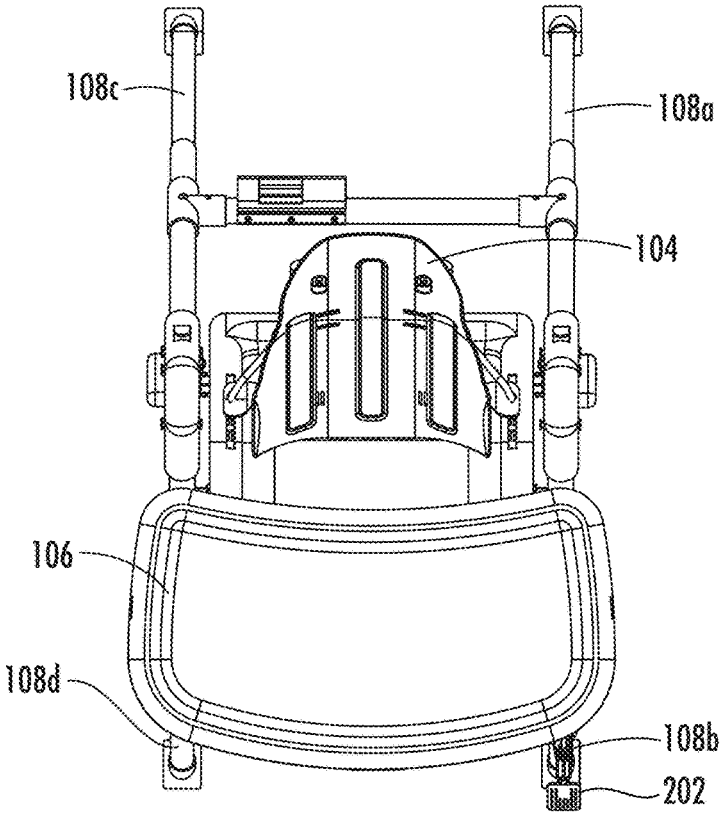
FIG. 3 is a top view of the highchair of FIG. 1.
Figure 4:
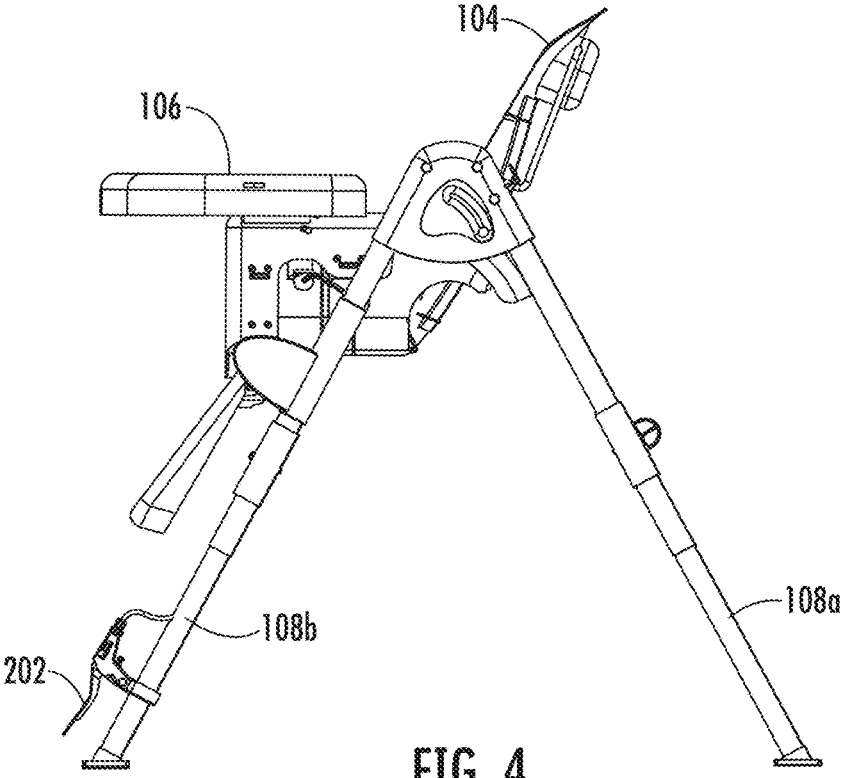
FIG. 4 is an elevational view of the highchair of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1-4, a highchair with a tray, generally designated 100, includes a frame 102, a seat 104, and a tray 106 rotatably secured to the frame 102. The frame 102 provides the structural support for the seat 104 that holds the child. In a particular aspect, the frame 102 comprises four legs 108*a*, 108*b*, 108*c*, 108*d* that may be configured to collapse together for storing the highchair 100.

The tray 106 has a first edge and an opposing second edge, where the first edge is rotatably secured to the first side of the frame 102 and configured to rotate between a down position and a raised position about the first edge. The tray 106 may also be removable from the frame 102.

A spring loaded lifting mechanism 110 is coupled to the first edge of the tray 106 and is biased to rotate the tray 106 from the down position over the seat 104 to the raised position so the seat 104 can be accessed.

A pedal 202 is secured to one of the legs (e.g. 108*b*) of the frame 102 and is configured to activate the movement of the tray 106. The pedal 202 is positioned so that it can be pushed with a foot of an adult while holding a child. The pedal 202 when pushed causes the tray 106 to release and rotate upwards to the raised position by the spring loaded lifting mechanism 110. The child can be placed in the seat 104 of the highchair 100 when the tray 106 is rotated to an up or raised position.

Figure 5:
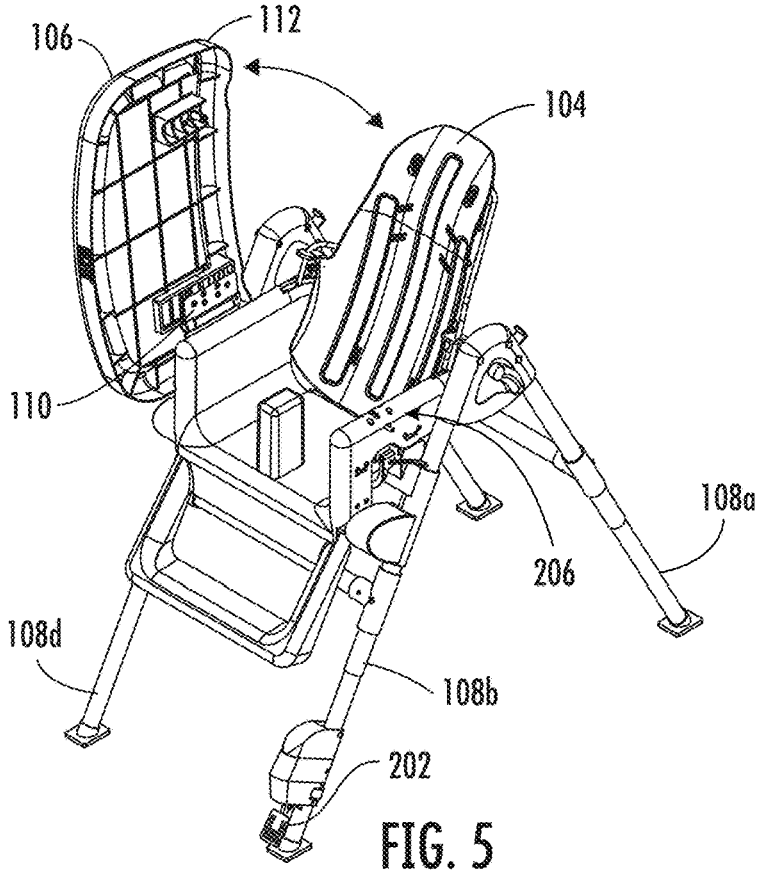
FIG. 5 is a top perspective view of the highchair of FIG. 1 having the tray in a raised up position.
Figure 6:
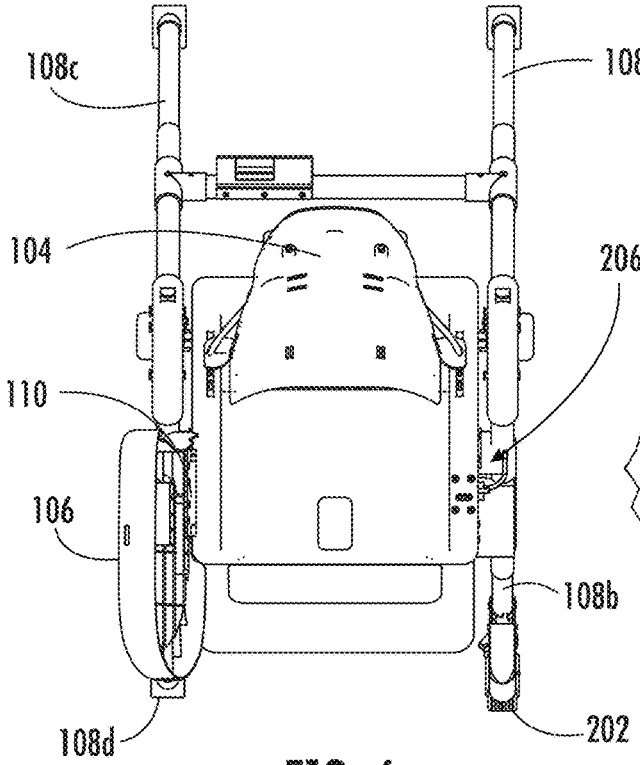
FIG. 6 is a top view of the highchair of FIG. 1 with the tray in the raised position.
Figure 7:
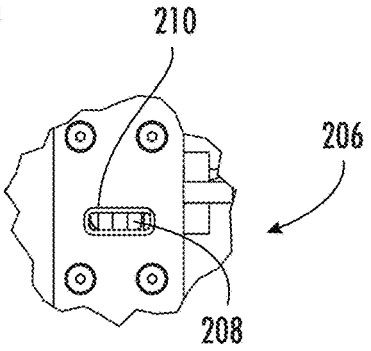
FIG. 7 is a detailed view of a latch catch mechanism of the highchair of FIG. 1.

Referring now to FIG. 5, the tray 106 is in the raised position. As described above, when the pedal 202 is pushed, it causes the tray 106 to be released from the down position and rotate upwards by the spring loaded lifting mechanism 110. The tray 106 is secured in the down position by a latch catch mechanism 206 coupled to the second side of the frame 102 as shown in FIGS. 6 and 7. The latch 206 includes a female fitting 210 or aperture and a latch catch 208 as shown in FIG. 7.

Figure 8:
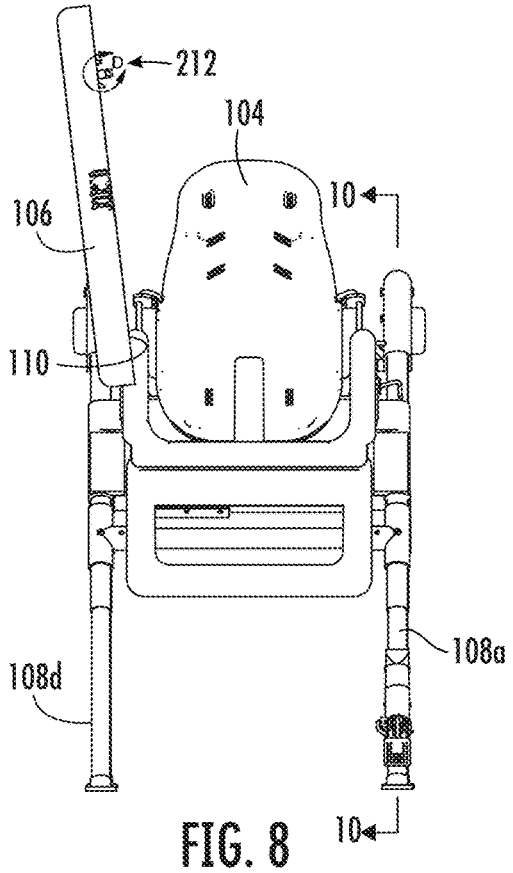
FIG. 8 is a front view of the highchair of FIG. 1 with the tray in the raised-up position.
Figure 9:
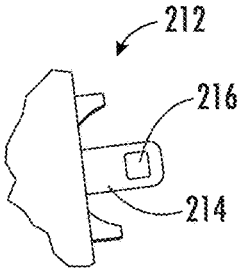
FIG. 9 is a detailed view of a latch of the highchair of FIG. 1.

The second edge of the tray 106 includes a latch 212 that is shown in FIGS. 8 and 9 and that is configured to cooperate with the latch catch mechanism 206 to secure the tray 106 in the down position. The latch 212 includes a male fitting 214 having an aperture 216 therethrough. The latch catch mechanism 206 is configured to receive the latch 212 and secure it through the aperture 216.

Figure 10:
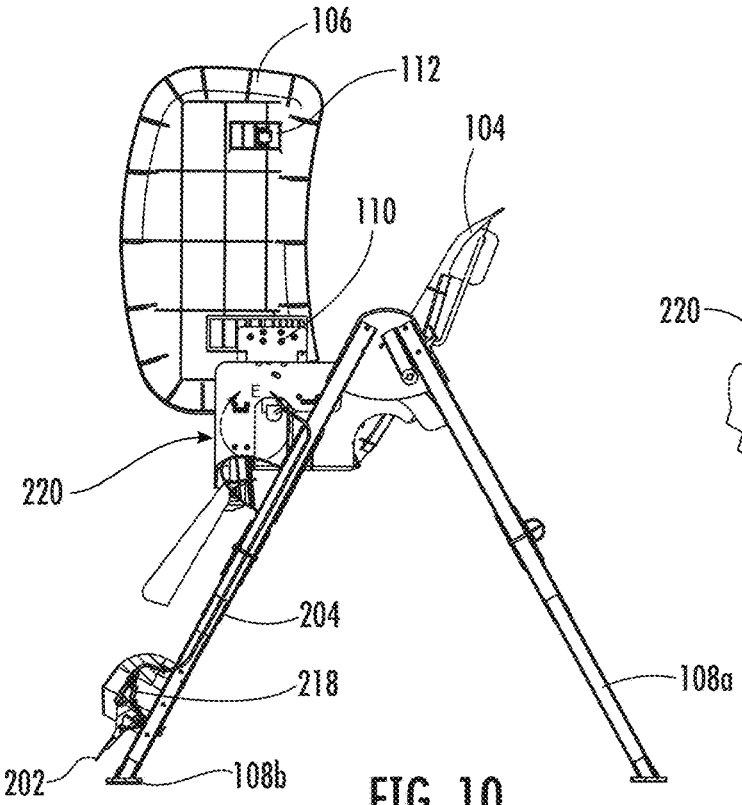
FIG. 10 is a partial cross sectional view taken in the direction of line 10-10 of FIG. 8.

Referring now to FIG. 10, the tray 106 may include a friction fit receiver 112 that is used to clamp the side of the tray 106 to the frame 102 of the highchair 100. The pedal 202 may include a safety lock 218 that is configured to prevent the pedal 202 from being pushed and inadvertently releasing the latch 212. A linkage 204 between the pedal 202 and the latch catch mechanism 206 is configured to cause the latch catch mechanism 206 to release the latch 212 when the pedal 202 is pushed. The linkage 204 may be a cable, for example.

Figure 11:
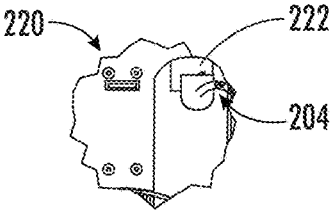
FIG. 11 is a detailed view of tray lock of the highchair of FIG. 1.

Accordingly, the highchair 100 may have a tray lock 220, as shown in FIG. 11, that is coupled between the second side of the frame 202 and the linkage 204. The tray lock 220 is configured to prevent the linkage 204 from moving and inadvertently releasing the latch 212.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope possible consistent with the principles and novel features as defined herein.

That which is claimed is:

1. A highchair for seating a child comprising:

a seat configured for a child to sit;

a frame having a first side and a second side, the frame attached to and supporting the seat at a height;

a tray having a first edge and an opposing second edge, the first edge rotatably secured to the first side of the frame and configured to rotate between a down position and a raised position about the first edge;

a spring loaded lifting mechanism coupled to the first edge of the tray and biased to rotate the tray from the down position over the seat to the raised position so the seat can be accessed; and a pedal coupled to a lower portion of the frame and configured to be pushed by a foot, wherein the pedal when pushed causes the tray to release and rotate upwards to the raised position by the spring loaded lifting mechanism;

wherein the pedal has a safety lock configured to prevent the pedal from being pushed and releasing the tray.

2. The highchair of claim 1, further comprising a latch catch mechanism coupled to the second side of the frame to secure the second edge of the tray thereto until the pedal is pushed.

3. The highchair of claim 2, wherein the second edge of the tray comprises a latch configured to cooperate with the latch catch mechanism to secure the tray in the down position.

4. The highchair of claim 3, further comprising a linkage between the pedal and the latch catch mechanism, wherein the linkage is configured to cause the latch catch mechanism to release the latch when the pedal is pushed.

5. The highchair of claim 4, wherein the linkage comprises a cable.

6. The highchair of claim 5, further comprising a tray lock coupled between the second side of the frame and the linkage and configured to prevent the linkage from moving and releasing the latch.

7. The highchair of claim 6, wherein the latch comprises a male fitting having an aperture therethrough, and the latch catch mechanism having a female fitting for receiving the male fitting and securing the latch through the aperture.

8. The highchair of claim 1, wherein the frame comprises four legs and is configured to collapse the four legs together for storing the highchair.

9. The highchair of claim 1, wherein the tray is removable from the frame.

10. A highchair for seating a child comprising:

a seat configured for a child to sit;

a frame having a first side and a second side, the frame attached to and supporting the seat at a height;

a tray having a first edge and an opposing second edge, the first edge rotatably secured to the first side of the frame and configured to rotate between a down position and a raised position about the first edge;

a spring loaded lifting mechanism coupled to the first edge of the tray and biased to rotate the tray from the down position over the seat to the raised position so the seat can be accessed;

a pedal coupled to a lower portion of the frame and configured to be pushed by a foot, wherein the pedal when pushed causes the tray to release and rotate upwards to the raised position by the spring loaded lifting mechanism;

a tray lock coupled between the second side of the frame and configured to prevent the tray from being inadvertently released and moving to the raised position;

a latch catch mechanism coupled to the second side of the frame to secure the second edge of the tray thereto until the pedal is pushed, wherein the second edge of the tray comprises a latch configured to cooperate with the latch catch mechanism to secure the tray in the down position; and a linkage between the pedal and the latch catch mechanism, wherein the linkage is configured to cause the latch catch mechanism to release the latch when the pedal is pushed, wherein the linkage comprises a cable.

11. The highchair of claim 10, wherein the latch comprises a male fitting having an aperture therethrough, and the latch catch mechanism having a female fitting for receiving the male fitting and securing the latch through the aperture.

12. The highchair of claim 10, wherein the frame comprises four legs and is configured to collapse the four legs together for storing the highchair.

13. The highchair of claim 10, wherein the tray is removable from the frame.

* * * * *